United States Patent [19]

Schmidt

[11] 4,018,632

[45] Apr. 19, 1977

[54] MACHINABLE POWDER METAL PARTS

[75] Inventor: Howard Schmidt, Pontiac, Mich.

[73] Assignee: Chrysler Corporation, Highland Park, Mich.

[22] Filed: Mar. 12, 1976

[21] Appl. No.: 666,519

[52] U.S. Cl. ..... 148/126; 148/13; 148/141; 148/134

[51] Int. Cl.[2] ..... B22F 3/24; C21D 1/00

[58] Field of Search ..... 148/126, 13, 141, 134

[56] References Cited

UNITED STATES PATENTS

| | | | |
|---|---|---|---|
| 2,400,302 | 5/1946 | Grange | 148/142 |
| 2,493,339 | 1/1950 | Campbell | 148/141 |
| 2,637,671 | 5/1953 | Pavitt | 148/126 |
| 3,062,693 | 11/1962 | Hudak et al. | 148/134 |
| 3,698,878 | 10/1972 | Hale | 148/126 |
| 3,860,457 | 1/1975 | Vourinen et al. | 148/141 |

FOREIGN PATENTS OR APPLICATIONS

| | | | |
|---|---|---|---|
| 45-21171 | 7/1970 | Japan | 148/126 |

OTHER PUBLICATIONS

Kahles, 1946 Reprint ASM, 1946 "Formation & Transformation Studies of iron–carbon powder alloys" pp. 12, 13, 32.

*Primary Examiner*—Brooks H. Hunt
*Attorney, Agent, or Firm*—Talburtt & Baldwin

[57] ABSTRACT

Method of preparing powder metal steel parts having improved machinability.

30 Claims, 1 Drawing Figure

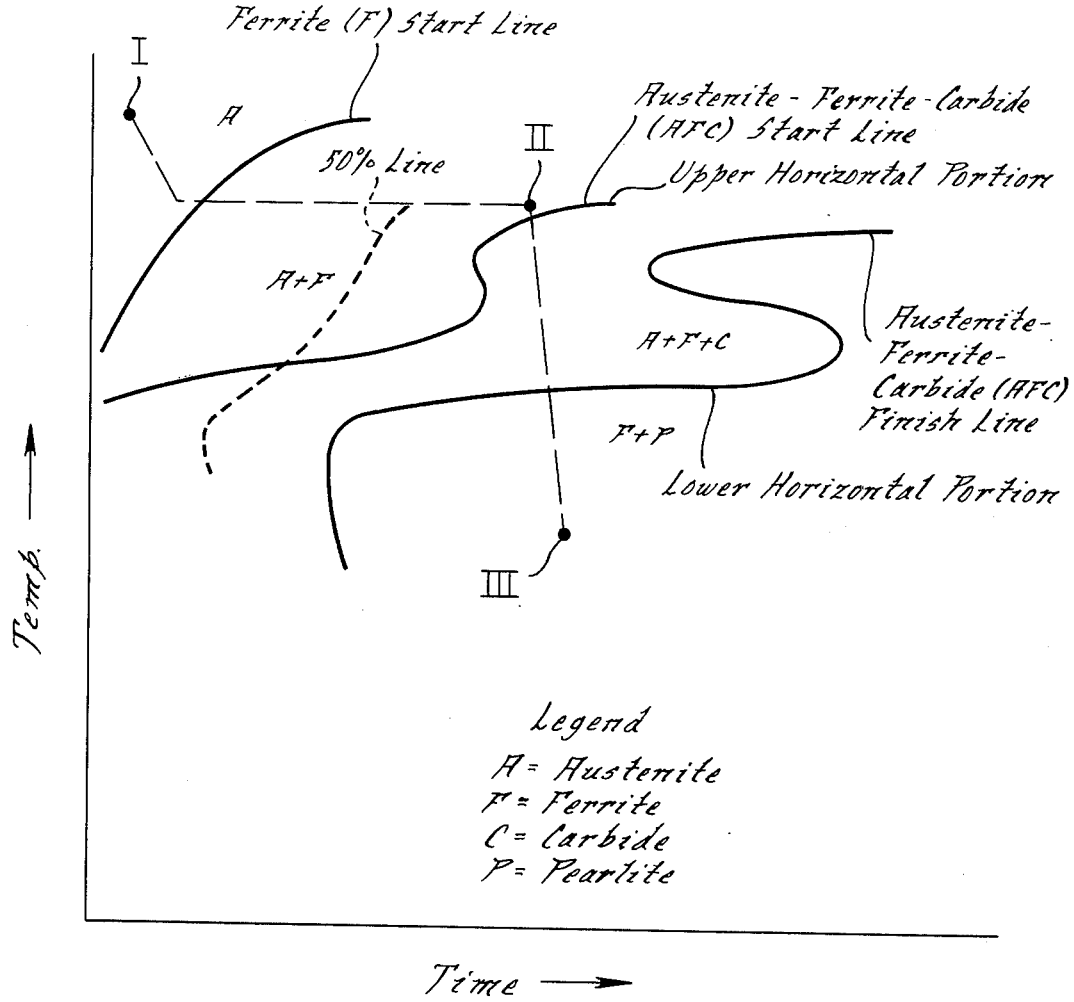
Ferrite (F) Start Line
I
A
50% Line
II
Austenite - Ferrite - Carbide (AFC) Start Line
Upper Horizontal Portion
A+F
A+F+C
Austenite-Ferrite-Carbide (AFC) Finish Line
F+P
Lower Horizontal Portion
III
Temp.
Legend
A = Austenite
F = Ferrite
C = Carbide
P = Pearlite
Time

MACHINABLE POWDER METAL PARTS

BACKGROUND

It is desirable from a cost and savings standpoint to replace the use of wrought steel machined parts e.g. axle drive gears for example, with machined parts made from powder metal steel. Such gears fabricated from powder metal steels have performed satisfactorily when tested for mechanical properties and when used in automobiles. Moreover, instead of using 16 pounds of wrought steel to make the 8 pound drive gear blank only 10 pounds of powder metal steel is required. Similar material savings are available for other parts as well.

Unfortunately, the same steel composition used in wrought steel parts cannot be directly substituted for use in powder metal steel parts due to oxidation problems which occur during the manufacture of the powder metal article. Therefore, a suitable steel powder metal composition must be selected which provides comparable mechanical properties but which is not prone to excessive oxidation during the manufacturing steps of the article. The most suitable compositions are ironmolybdenum alloys of a low Mn content of about 0.9% or less (% refers to percent by weight throughout). Parts are made from such alloy powders which have been mixed with carbon in the form of graphite particles and a suitable compacting lubricant. A preferred composition for powder metal ring gears comprises 0.3 to 0.5% MO, about 0.25% C, about 0.2–0.6% Mn, balance substantially iron.

As previously stated, gears fabricated from such powder metal steel perform satisfactorily when tested for mechanical properties and when used in automobiles. However, a problem has been encountered in machining these parts from a high volume, mass production standpoint. For example, when machining standard forged wrought steel gear blanks it is possible to produce about 400 gears before any machine tool changes are required due to wear. On the other hand, when machining powder metal blanks made by current practices, it has been possible to produce only about 50 gears before making machine tool changes. Such poor machinability has made it uneconomical to substitute the use of powder metal steel parts for forged wrought steel parts in mass production situations where machining is necessary to the final part.

In studying the machinability problem in the context of such powder metal compositions it was concluded that the poor machinability of such powder metal steel parts could be attributed to undesirable microstructures produced by the standard heat treatment procedures in preparing the parts. By analyzing the microstructures of such parts it was discovered that standard heat treatment procedures produced undesirable coarse carbides mixed with the desirable pearlite type of carbides in the ferrite matrix of the powder metal steel part. It was thus recognized that a new heat treatment was required for powder metal steel parts which would avoid the formation of the coarse carbides and favor ferrite-pearlite formation. Such a method is provided by this invention.

SUMMARY OF THE INVENTION

In its general aspects the invention is a method which comprises the steps of heating a powder metal workpiece or part to a temperature at which an austenitic microstructure is produced and then cooling the part to a lower first temperature range in which transformation of some of the austenite to ferrite occurs. It is critical at this point to avoid the formation of carbides and the cooling temperature must be so selected. The remaining austenite becomes carbon enriched. The part is then rapidly cooled to a lower second temperature range in which the remaining austenite transforms to additional ferrite and to pearlite. The material in the part, when transformation is complete, consists of equiaxed ferrite and pearlite a desirable structure for machining.

BRIEF DESCRIPTION OF THE DRAWING

The drawing FIGURE is an illustrative, somewhat idealized, time-temperature-transformation graph for powder steel of the Fe-C-Mo-Mn type.

DESCRIPTION OF THE PREFERRED EMBODIMENT

In accordance with this invention, steel parts exhibiting improved machinability are prepared from an alloy powder metal, e.g., 0.5% Mo, 0.5% Mn, balance Fe, or 0.3% Mo, 0.2% Mn, balance Fe, mixed with graphite in proportions suitable to provide a preferred final steel composition in the part e.g., 0.5% Mo, 0.5% Mn, 0.25% C, balance Fe. For example, a mixture of 0.35% graphite, 0.75% zinc stearate compacting lubricant and 98.90% Fe-Mo alloy powder (0.5% Mo, 0.5% Mn, balance Fe powder alloy composition) provides a final part having a composition of 0.5% Mo, 0.5% M, 0.25% C, balance Fe. Any suitable compacting lubricant may be used.

The invention may make use of any powder metal mixture which provides a resultant composition of about 0.3 to 0.5% Mo, less than about 0.9% Mn, less than about 0.45% C, balance essentially Fe. This invention more specifically contemplates a method wherein the resultant powder metal steel compositions comprise about 0.3 to 0.5% Mo, about 0.25% C, about less than 0.6% Mn (about 0.2% to 0.5% Mn is more preferred), balance essentially iron. Using more than about 0.6% Mn produces oxidation problems in the powder. Above about 0.9% Mn the oxidation problem becomes so extensive that substantial hardenablility is lost. As the Mn content increases to 0.9%, the Mo content may be decreased.

In its broadest aspects, the method of the invention is directly applicable to all steel compositions whether powder metal or not, which includes as constituents there of about 0.3–0.5% Mo, less than about 0.9% Mn, and less than about 0.45% C wherein austenitic structures ferrite structures and carbides are formed upon cooling.

In practicing the method when a powder metal is used, the powder mixture is compacted, preferably at a pressure of about 30 tons/sq. inch to form a green article, workpiece or part which is then sintered in a non-oxidizing atmosphere at elevated temperatures e.g., about 2100°–2300° F. for a time adequate to substantially reduce the oxides of iron, manganese, molybdenum, etc. Following sintering, the part is worked and formed at an elevated temperature to a desired shape; such as by hot forming, hot forging or hot coining. Hot forming is the preferred technique. The term hot forming shall be used hereinafter in a collective sense to indicate all of the foregoing hot working techniques. Forming is preferably done while the part is still hot as a result of the sintering step and may be conveniently accomplished immediately on removal of the part from the sintering furnace.

The resultant article or part is then subjected to the heat treatment provided by this invention. This may be accomplished while the part is at temperature from the foregoing step or following a period after which the part has cooled. In any event, the part must be in the austenitic state when initiating the heat treatment. The heat treatment involves heating the part to an austenitizing temperature which requires temperatures in excess of the critical temperature, which is dependent on the carbon content desired, and holding at that temperature for a time sufficient to assure that the part is substantially transformed to an austenitic structure. In the case of the preferred compositions described herein the preferred temperature range is from about 1600° to about 2200° F. with a holding time ranging from about 20 minutes to about 1 hour. A holding temperature of about 1750° F., as indicated at 1 in the Figure, with a holding time of about 1 hour is most preferred. Austenitizing as is used in standard heat treating procedures is generally acceptable in accomplishing this step insofar as other compositions are concerned.

Following austenitization and/or heating as at I in FIG. 1, the part is cooled to a first temperature range and held thereat for a time to transform some of the austenite to ferrite. Quenching may be used and is preferred for cooling to the first temperature range in this step. It is critical in this step that the formation of carbides is substantially avoided. Therefore, the temperature range and holding period must be selected to make certain that the part is maintained to the left of the AFC start line or above the upper horizontal portion of the AFC start line on the time-temperature transformation curve for the particular alloy involved. For example, the graph in the Figure is representative of the preferred composition described hereinabove, i.e., 0.5% Mo, 0.25% C, 0.5% Mn, balance Fe. The AFC start line represents the time-temperature conditions at which the alloy in the part will start to transform from a mixture of austenite and ferrite to a mixture of austenite and ferrite and carbides. At this point in the method, the part must be maintained at time-temperature conditions to the left of and above the AFC start line to avoid the type of carbide formation which occurs in the area between the AFC start line and the AFC finish line on the graph. The undesirable carbide formation which occurs in that area is primarily responsible for poor machinability. In the case of the preferred composition, point II on the graph is representative of the termination point of a preferred holding condition which is between about 1100° and about 1300°–1350° F. for at least about 5 minutes (about 1325° F for about 15 minutes being preferred) which is typical of the required conditions resulting in a partial transformation of austenite to ferrite leaving some austenite enriched in carbon but avoiding carbide formation.

After this the part is rapidly cooled further, as by quenching, to a second temperature below the lower horizontal portion of the AFC finish line on the graph, i.e., a temperature at which some of the remaining austenite transforms into additional ferrite and some of the remaining austenite transforms into the lamellar carbide known as pearlite. The purpose of the rapid cooling is to pass the part through the area on the graph between the AFC start line and the AFC finish line so rapidly that substantially no transformation can occur and the formation of coarse carbide is substantially avoided. Thus, transformation does not take place until the part has reached the desired second temperature range, i.e., below or to the right of the AFC finish line, and ferrite and pearlite formation begins, as at point III on the graph. For the preferred composition, such a second lower temperature range is between about 600° and 1000° F., 15 minutes transformation time at 850° F. being preferred. In any event, once the remaining austenite has transformed substantially completely to ferrite and pearlite, the part may be allowed to cool to room temperature in any convenient fashion or otherwise processed.

The resultant microstructure will be found to essentially comprise equiaxed ferrite and pearlite which is readily machinable.

Having described the invention, exclusive rights are claimed thereto as follows:

What is claimed is:

1. A method of producing machinable steel parts comprising about 0.3 to 0.5% Mo, less than about 0.45% C, less than about 0.9% Mn, balance essentrally iron from powder metal, comprising the steps:

providing a powder metal steel part, heating the part for a time at a temperature which insures the presence of a substantially austenitic structure in the part, cooling the part to a first temperature range below the heating temperature, the range being within that at which the part may be held for a period of time to partially transform some of the austenite formed during heating to ferrite without forming any substantial amount of carbides, holding the part within the first temperature range for a period of time sufficient to effect the partial transformation of the austenite, the remaining austenite becoming carbon enriched as a result thereof, rapidly cooling the part, at a rate which avoids substantially any transformation during the cooling, to a second temperature range below the first temperature range, within which second temperature range the part may be held for a period of time to substantially transform the remaining austenite to ferrite and pearlite without any other type of substantial carbide formation, and holding the part within the second temperature range for a period of time sufficient to effect the substantial transformation.

2. The method of claim 1 wherein the powder metal part comprises about 0.3 to 0.5% Mo, about 0.25% C, less than about 0.6% Mn, balance essentially iron.

3. The method of claim 1 wherein the initial heating temperature is from about 1600° to about 2200° F.

4. The method of claim 1 wherein the initial heating temperature is about 1750° F.

5. The method of claim 1 wherein the holding periods for the first and second temperature ranges are from about 5 minutes to about 1 hour.

6. The method of claim 1 wherein the first temperature range is between about 1100° to about 1350° F. and the holding period is at least about 5 minutes but less than the time required to form carbides within that temperature range.

7. The method of claim 6 wherein the temperature is about 1325° F. and the holding time is less than about 15 minutes.

8. The method of claim 1 wherein the rapid cooling to the second temperature range is by quenching.

9. The method of claim 1 wherein the second temperature range is below about 1000° F.

10. The method of claim 9 wherein the second temperature range is below about 1000° and above about 600° F.

11. The method of claim 10 wherein the second temperature range is about 850° F. and the holding time is about 15 minutes.

12. The method of claim 1 wherein the range of the Mn is between about 0.2 and 0.5%.

13. The method of claim 1 wherein the powder metal part is hot formed and the hot forming temperature provides the initial heating.

14. A method of preparing powder metal steel parts comprising about 0.3 to 0.5% Mo, less than about 0.45% C, less than about 0.9% Mn, balance essentrally iron which exhibit improved machinability, comprising the steps:

preparing a steel forming powder mixture, compacting and sintering the mixture, hot forming the sintered compact to a desired part shape, the hot forming temperature being high enough to insure the presence of a substantially austenitic structure in the part, cooling the part to a first temperature range below the hot forming temperature, within which temperature range the part may be held for a period of time to partially transform the austenite to ferrite without forming any substantial amount of carbides, holding the part within the first temperature range for a period of time sufficient to effect the partial transformation of the austenite, the remaining austenite becoming carbon enriched as a result thereof, rapidly cooling the part, at a rate which avoids substantially any transformation during the cooling, to a second temperature range below the first temperature range, within which second temperature range the part may be held for a period of time to substantially transform the remaining austenite to ferrite and pearlite without any other type of substantial carbide formation, and holding the part within the second temperature range for a period of time sufficient to effect the substantial transformation.

15. The method of claim 14 wherein the steel powder mixture comprises an Fe-Mo-Mn alloy and graphite.

16. The method of claim 15 wherein the mixture is about 98.90% Fe-Mo-Mn, about 0.35% graphite and includes about 0.75% of a compacting lubricant.

17. The method of claim 14 wherein the steel powder mixture is selected to provide a sintered compact having a composition of about 0.3 to 0.5% Mo, less than about 0.45% C, less than about 0.9% Mn, balance essentially iron.

18. The method of claim 15 wherein the composition is about 0.3 to 0.5% Mo, about 0.25% C, less than about 0.6% Mn, balance essentially iron.

19. The method of claim 17 wherein the hot forming temperature is from about 1600° to about 2200° F.

20. The method of claim 17 wherein the hot forming temperature is about 1750° F.

21. The method of claim 17 wherein the holding periods for the first and second temperature ranges are from about 5 minutes to about 1 hour.

22. The method of claim 17 wherein the first temperature range is between about 1100° to about 1350° F and the holding period is at least about 5 minutes but less than the time required to form carbides within that temperature range.

23. The method of claim 22 wherein the temperature is about 1325° F and the holding time is less than about 15 minutes.

24. The method of claim 14 wherein the rapid cooling to the second temperature range is by quenching.

25. The method of claim 17 wherein the second temperature range is below about 1000° F.

26. The method of claim 25 wherein the second temperature range is below about 1000° and above about 600° F.

27. The method of claim 26 wherein the second temperature range is about 850° F and the holding time is about 15 minutes.

28. The method of claim 17 wherein the range of the Mn is between about 0.2 and 0.5%.

29. A method of producing steel parts comprising about 0.3 to 0.5% Mo, less than about 0.45% C, less than about 0.9% Mn, balance essentrally iron, comprising the steps:

providing a steel part, heating the part to an austenitizing temperature, cooling the part to a first temperature range below the austenitizing temperature and above the upper horizontal portion of the austenite-ferrite-carbide start line on a time-temperature-transformation graph for the particular steel composition of the part and of the general type shown in the drawing Figure, maintaining the part within that temperature range for a period of time short of the AFC start line and sufficient to partially transform some of the austenite to ferrite without any accompanying substantial formation of carbides, rapidly cooling the part to a second temperature range below the first temperature range and below the lower horizontal portion of the AFC finish line on the time-temperature-transformation graph for the alloy, and maintaining the part within that temperature range for a period of time sufficient to substantially transform any remaining austenite to a mixture consisting essentially of ferrite and pearlite.

30. The method of claim 29 wherein the part is hot formed and the hot forming temperature is the austenitizing temperature for the initial heating step.

* * * * *